United States Patent [19]

Isozumi

[11] Patent Number: 4,902,904

[45] Date of Patent: Feb. 20, 1990

[54] COAXIAL ENGINE STARTER

[75] Inventor: Shuzoo Isozumi, Himeji, Japan

[73] Assignee: Mitsubishi Denki Kabushiki Kaisha, Japan

[21] Appl. No.: 279,220

[22] PCT Filed: Feb. 3, 1988

[86] PCT No.: PCT/JP88/00098

§ 371 Date: Oct. 4, 1988

§ 102(e) Date: Oct. 4, 1988

[87] PCT Pub. No.: WO88/05865

PCT Pub. Date: Aug. 11, 1988

[30] Foreign Application Priority Data

Feb. 5, 1987 [JP] Japan ..... 62-16936
Feb. 27, 1987 [JP] Japan ..... 62-29108

[51] Int. Cl.[4] ..... F02N 15/06

[52] U.S. Cl. ..... 290/48; 74/7 A; 335/261

[58] Field of Search ..... 290/48; 345/258, 261; 74/7 R, 7 A

[56] References Cited

U.S. PATENT DOCUMENTS 2,433,703 12/1947 Mekelburg ..... 335/261
4,339,109 7/1982 Kawata et al. ..... 335/261 X
4,539,542 9/1985 Clark ..... 335/261
4,583,067 4/1986 Hara ..... 335/261
4,604,600 8/1986 Clark ..... 335/261
4,707,616 11/1987 Ogle et al. ..... 290/48
4,760,274 7/1988 Isozumi ..... 290/48
4,838,100 6/1989 Tanaka ..... 74/7 A

FOREIGN PATENT DOCUMENTS 0146951 7/1985 European Pat. Off. .
2507940 9/1976 Fed. Rep. of Germany .
2353720 12/1977 France .

*Primary Examiner*—A. D. Pellinen
*Assistant Examiner*—W. E. Duncanson, Jr.
*Attorney, Agent, or Firm*—Leydig, Voit & Mayer

[57] ABSTRACT

A coaxial engine starter comprising a solenoid switch assembly including a non-magnetic sleeve disposed side by side relative to the iron-system bushing for guiding the plunger in a moving space from its return position to the position in which the plunger abuts against the front magnetic path section. An end face of the rear magnetic path section on the side of the front magnetic path section is an outwardly facing slope surface. The direction of twist of the helical spline formed on the output rotary shaft is opposite to the direction of wind of the return coil spring.

3 Claims, 3 Drawing Sheets

COAXIAL ENGINE STARTER

TECHNICAL FIELD

This invention relates to a coaxial engine starter and, more particularly, to a coaxial engine starter for use in starting a vehicular engine.

BACKGROUND ART

A conventional engine starter for use in starting up a vehicular engine has been constructed as shown in FIG. 1.

The conventional starter 1 shown in FIG. 1 comprises a d.c. motor 2, an over-running clutch mechanism 4 slidably mounted over an armature rotary shaft 3, a planetary gear speed reduction unit 5 for reducing and transmitting the rotating speed of the armature rotary shaft 2*a* of the d.c. motor 2 to a clutch outer member 4*a* of the over-running clutch mechanism 4, and a shift lever 8 engaged at its one end with a plunger rod of a solenoid switch assembly 6 which is disposed on one side of the d.c. motor 2 for slidably moving the over-running clutch assembly 4 and at its the other end with an annular member 7 mounted to the overrunning clutch mechanism 4.

However, the conventional starter 1 needs the shift lever 8 for sliding the over-running clutch mechanism 4 on the output rotary shaft 3, and since the bi-axial arrangement, in which the electromagnetic switch assembly 6 for actuating the shift lever 8 and supplying electric power to the d.c. motor 2 is disposed on the side of the d.c. motor 2, is employed, strict limits are imposed on engine layout during the design of the vehicle.

In order to eliminate the above problem, it has been proposed to position the solenoid switch on one of the axial end portions of the d.c. motor to form the starter into a simple configuration such as an elongated cylinder. According to this proposition, the basic construction is such that the armature rotary shaft is made hollow and the plunger rod of the solenoid switch assembly which has been used to operate the shift lever is elongated to extend through the inner passage of the armature elecromagnetic core to reach the output rotary shaft. The starter having such construction is referred to as a coaxial starter since the armature rotary shaft of the d.c. motor and the rod of the solenoid switch are coaxially aligned.

However, while the above-discussed coaxial starter is a simple elongated cylindrical member, the overall axial length is significant if the solenoid switch assembly is simply attached to the rear end of the d.c. motor. On the other hand, if the solenoid switch assembly is simply reduced in size, it is difficult to maintain the necessasry magnetic attractive force. Therefore, the development of a coaxial starter of the above structure with a shorter overall length has been expected.

DISCLOSURE OF THE INVENTION

It is an object of the present invention is to provide a coaxial engine starter in which the overall axial length is short while an appropriate attractive force is maintained in the solenoid switch assembly.

The coaxial starter of one embodiment of the present invention comprises a solenoid switch assembly disposed on the rear end of an electric motor for generating a rotating force for starting an engine. The solenoid switch assembly comprises a cylindrical excitation coil, a plunger axially slidable within the excitation coil, a front magnetic path section disposed on one end of the excitation coil in opposition to the plunger, a rear magnetic path section disposed around the circumference of the plunger when it is in the return position, a bushing of an iron-system material disposed between the rear magnetic path section and the plunger, and a non-magnetic sleeve disposed side by side relative to the iron-system bushing for guiding the plunger in a moving space from its return position to the position in which the plunger abuts against the front magnetic path section.

According to the coaxial starter of this embodiment, when an electric current flows through the solenoid switch assembly to energize the excitation coil, a magnetic flux flows from the rear magnetic path section to the front magnetic path section through the iron-system bushing and the plunger to generate a magnetic attractive force between the plunger and the front magnetic path section. At this time, since the non-magnetic sleeve for guiding the plunger over the travel distance of the plunger is disposed along the iron-system bushing, no magnetic flux leaks, providing a stronger magnetic attractive force between the plunger and the front magnetic path section, resulting in the movement of the plunger under a greater force. During this movement of the plunger, the electric motor is turned on and the output rotary shaft with a pinion gear on it is pushed out to transmit the rotating force to the engine.

The coaxial starter of anoter embodiment of the present invention is characterized by an axially slidable output rotary shaft extending through a clutch inner member of an over-running clutch mechanism and in mesh with the clutch inner member and a helical spline, and a coil spring disposed around the output rotary shaft and abutting at its one end with a side face of a radially outwardly projecting portion of the output rotary shaft, and that the coil spring achieves the return of the output rotary shaft and the return of the plunger of the solenoid switch assembly and that the direction of twist of the helical spline formed on the output rotary shaft is opposite to the direction of wind of the return coil spring.

According to the coaxial starter of the this embodiment, when an electric current flows through the solenoid switch assembly, its rod pushes the output rotary shaft against the action of the return coil spring and at the same time the d.c. motor is energized. This causes the rotating force on the armature rotary shaft of the electric motor to be transmitted to the output rotary shaft through the over-running clutch mechanism. After the engine has been started, the solenoid switch assembly is de-energized and the output rotary shaft is returned back to its original position by the return coil spring. This return force also functions on the rod of the solenoid switch assembly through the output rotary shaft. When, the output rotary shaft is being pushed out by the solenoid switch assembly, the output rotary shaft rotates as it slides along the twist direction of the helical spline because the output rotary shaft is in mesh with the clutch inner member of the over-running clutch mechanism through the helical spline. During this time, since the return coil spring disposed around the output rotary shaft and abutted at its one end with the radially outwardly extending portion of the output rotary shaft is wound in a direction opposite to the direction of twist of the helical spline, the coil spring is twisted in its diameter-expanding direction due to the sliding contact of its one end with the output rotary shaft. Therefore, the coil spring does not provide a large drag against the sliding movement of the output rotary shaft.

BEST MODES FOR CARRYING OUT THE INVENTION

The coaxial engine starter of the present invention will now be described in conjunction with a preferred embodiment of the present invention shown in the accompanying drawings.

Figure 2:
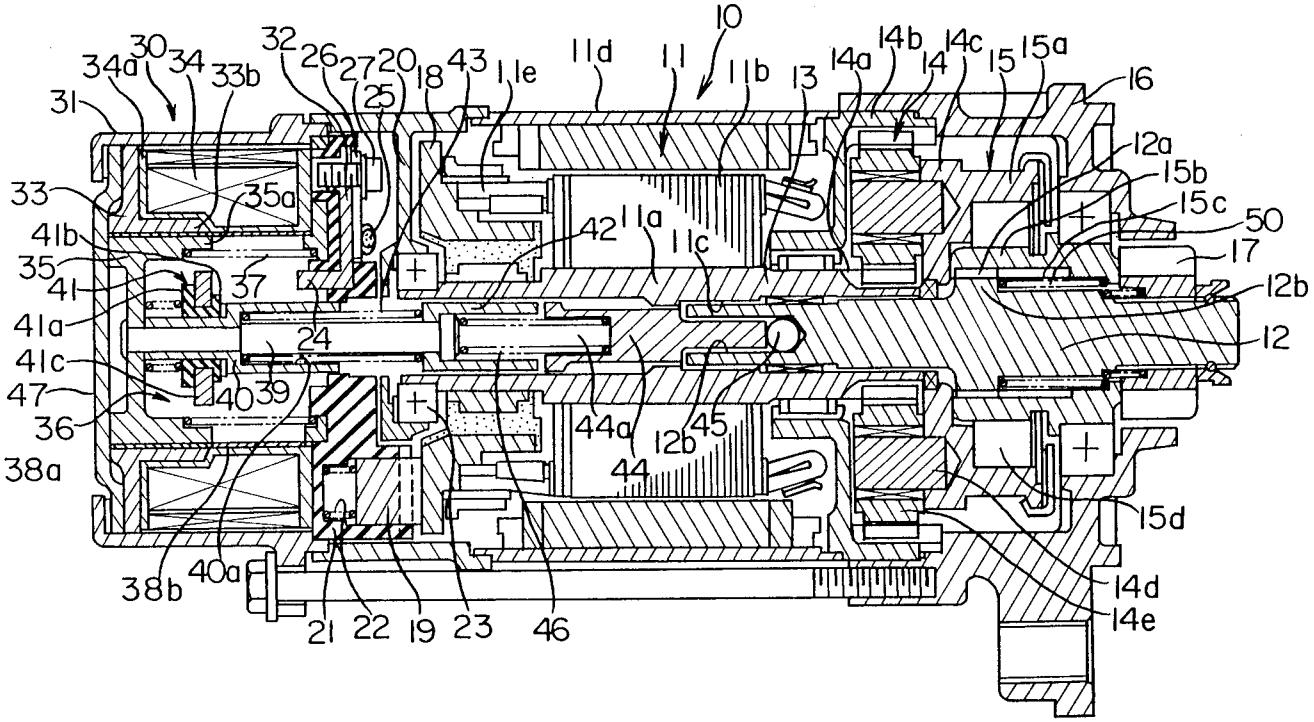
FIG. 2 is a longitudinal cross-sectional view showing the coaxial engine starter of an embodiment of the present invention.

FIG. 2 illustrates a coaxial engine starter 10 of one embodiment of the present invention. The coaxial engine starter 10 of this embodiment comprises a d.c. motor 11 having a tubular armature rotary shaft 11*a* arranged on the central axis. On the outer circumference of the tubular armature rotary shaft 11*a*, an armature core 11*b* is secured by press fit. On one axial end (on the right in FIG. 2) of the d.c. motor 11, a pinion shaft or an output rotary shaft 12 is disposed in an axial aligned relationship with the armature rotary shaft 11*a*. This output rotary shaft 12 is inserted at its one end within the an inner passage 11*c* of the armature rotary shaft 11*a* and is axially slidably supported by means of a sleeve bearing 13 interposed between the inner circumference of the inner passage 11*c* and the output rotary shaft 12.

The transmission of the rotating force of the armature rotary shaft 11*a* to the output rotary shaft 12 is achieved through a planetary gear speed reduction unit 14 and an over-running clutch mechanism 15. That is, the planetary gears speed reduction unit 14 comprises a sun gear 14*a* integrally formed on an outer circumferential portion of one end of the armature rotary shaft 11*a*, an inner gear 14*b* mounted between the yoke 11*d* of the d.c. motor 11 and the front bracket 16 of the starter assembly, and a plurality of planetary gears 14*e* engaging with the sun gear 14*a* and the inner gear 14*d* and rotatably carried by pins 14*d* secured to a carrier 14*c* integral with a clutch outer member 15*a* of the over-running clutch mechanism 15. A helical spline 15*c* is formed on the inner circumferential surface of the clutch inner member 15*b* of the over-running clutch mechanism 15 and is in mesh with a helical spline 12*a* formed on the outer circumferential surface of the output rotary shaft 12, so that the output rotary shaft 12 is capable of sliding in the axial direction even when the rotating force is being applied thereto from the clutch inner member 15*b*. On the side of the output rotary shaft 12 which projects from the front bracket 16, a pinion 17 for meshing with and driving the ring gear of the engine is mounted.

The d.c. motor 11 is provided with a face-type commutator 18 mounted on the outer circumference on one end or on the lefthand end in FIG. 2 of the armature rotary shaft 11*a*. The face-type commutator 18 is provided with a plurality of segments disposed in a plane perpendicular to the armature rotary shaft 11*a* for sliding contact with a plurality of brushes 19 for commutation, each of the segments being connected to one end of the armature coil 11*e* wound on the armature core 11*b*.

The brushes 19 are supported by brush holders 21 made of plastic disposed outside of the rear bracket portion 20 separately formed with the yoke 11*a* and coupled to this yoke by an interlocking portion and are pressed by a spring 22 against the slide surface of the commutator 18 through the respective openings formed in the rear bracket 20. A bearing 23 is fitted on the inner circumferential surface of the central opening of the rear bracket 20, and this bearing 23 supports the rear end portion which is on the commutator-side of the armature rotary shaft 11*a*. The brush holder 21 is constructed by insert-molding a stationary contact 24 which is connected to an unillustrated terminal on the rear portion, and by securing by a screw 27 a terminal 26 to which a plus side lead wire 25 of the brush 19 is welded.

Further, the engine starter 10 of the present invention comprises a solenoid switch assembly 30 (simply referred to as a switch assembly hereinafter) which causes the output rotary shaft 12 to slide and which has a switching function for turning on the electrical contacts as will be described in detail later for supplying electrical power from the battery (not shown) to the d.c. motor 11 by the closure of the key switch (not shown) of the vehicle. The switch assembly 30 is connected to the outer side of the rear bracket portion 20.

The switch assembly 30 comprises an excitation coil 34 wound on a plastic bobbin 34*a* supported by front and rear magnetic path sections or cores 32 and 33 which define, together with a casing 31, a magnetic circuit. The switch assembly 30 also comoprises a plunger 35 slidably disposed within a central bore of the bobbin 34*a* and a movable assembly 36 mounted to the plunger 35. The plunger 35 comprises a tubular magnetic path section 35*a*, and the end portion of the tubular magnetic path section 35*a* opposes the front core 32. A non-magnetic coil spring 37 such as of stainless steel is disposed between the step portion 35*b* formed in the inner cirfumference of the magnetic path section 35*a* and the front core 32. The coil spring 37 functions to cause the plunger 35 to return to its return position shown in FIG. 2 when the key switch is returned to the off position.

The rear core 33 includes a cylindrical magnetic path section 33*a* positioned on the outer circumference of the cylindrical magnetic path 35*a* of the plunger 35 when the latter is in the return position. According to the present invention, the front core side end face 33*b* of the rear magnetic path section 33*a* is a sloped surface facing outwardly, so that the end portion of the magnetic path section 33*a* is sharp at its tip. Further, a tubular bushing 38*a* made of an iron-system material is disposed between the plunger 35 in the return position and the rear core 33. A non-magnetic tubular sleeve 38*b* made of stainless steel for example and having an inner diameter equal to that of the iron-system bushing 38*a* is disposed in alignment with the iron-system bushing 38*a* and between the front core and the rear core 32 so as to guide the plunger 35.

The movable assembly 36 comprises a rod 39 connected at one end to the plunger 35 and positioned at the other end in opposition to the rear end (lefthand end in FIG. 2) of the output rotary shaft 12, and a first holder 40 having an opening 40*a* open toward the output rotary shaft side secured to the outer circumference of the plunger side portion of the rod 39. The first holder 40 has slidably mounted on its outer circumferential portion a movable contact member 41 having a movable contact 41*c* disposed between two insulators 41*a* and 41*b*. A second holder 42 is axially slidably mounted on the outer circumferential surface of the other end of the rod 39, and a spring 43 is disposed between the second holder 42 and the inner end of the opening of the first holder 40 for biasing the output rotary shaft 12 forward or toward the right in FIG. 1. Also, the other end or the front end of the rod 39 and the second holder 42 are inserted into the armature rotary shaft 11*a* of the d.c. motor 11 from the other end. Within the hollow shaft of the armature rotary shaft 11*a*, a push rod 44 is disposed with its front end in contact with the end wall of the hole 12*b* formed in the end face of the output rotary shaft 12 through a steel ball 45. Also, a coil spring 46 is disposed between the end wall of the hole 44*a* formed in the end face of the pusher rod 44 and the front end face of the rod 39.

One end of the second holder 42 extends from the front end of the rod 39 toward the pusher rod 44 to enclose the coil spring 46. The reference numeral 47 designates a non-magnetic plate for closing the rear end of the case 31, which functions as a stop for preventing the rearward return of the plunger 35 beyond it and as a rear wall of the solenoid switch assembly 30.

The operation of the engine starter 10 of the above embodiment will now be described.

Figure 3:
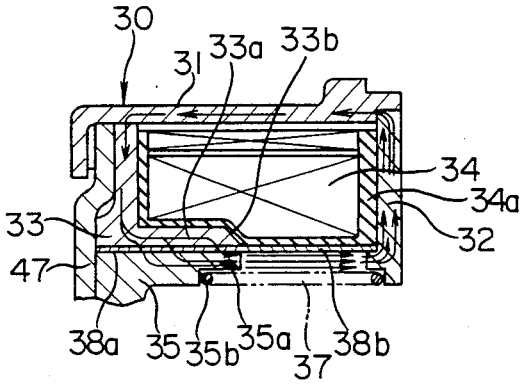
FIG. 3 is a fragmental cross-sectional view showing the flow of the magnetic flux in the solenoid switch assembly of the coaxial starter shown in FIG. 2.
Figure 4:
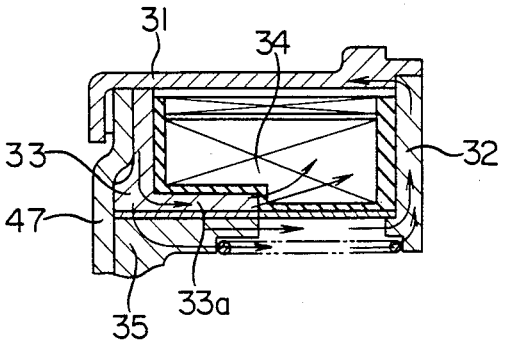
FIG. 4 is a cross-sectional view showing the leakage of the magnetic flux in the conventional solenoid switch assembly.

When the starter switch is turned on, the excitation coil 34 of the solenoid switch assembly 30 is energized. Due to the energization of the excitation coil 34, a magnetic flux generates to extend from the cylindrical magnetic path section 33*a* of the rear core 33 to the plunger 35 through the iron-system bushing 38*a*, and from the magnetic path section 35*a* of the plunger 35 to the opposing front core 32 as shown in FIG. 3. If, as shown in FIG. 4, no non-magnetic sleeve 38*b* is used and instead a magnetic bushing 38*c* is disposed between the front and the rear magnetic cores 32 and 33, most of the magnetic flux between the front and rear cores 32 and 33 flows through such the magnetic bushing 38*c* and only a small magnetic flux flows from the plunger magntic path section 35*a* to the front core 32. Therefore, it is impossible to obtain a large magnetic attractive force between the plunger 35 and the front core 32.

Moreover, in the case that the tip of the magnetic path section 33*a* of the rear core 33 is formed in a plane perpendicular to its axis as shown in FIG. 4, or in the case that the spring for returning the plunger 35 is made of a magnetic material, a magnetic flux leaks from these portions as seen from FIG. 4, making it difficult to provide a large magnetic attractive force between the plunger 35 and the front core 32.

According to the engine starter 10 of this embodiment of the present invention, since the iron-system bushing 38*a* is disposed between the plunger in the return position and the magnetic path section 33*a* of the rear core 33, and the non-magnetic sleeve 38*b* only for guiding the plunger 35 is disposed between the iron-system bushing 38*a* and the front core 32, the leakage of the magnetic flux is reduced and the magnetic attractive force acting on the plunger 35 is significantly increased.

Figure 1:
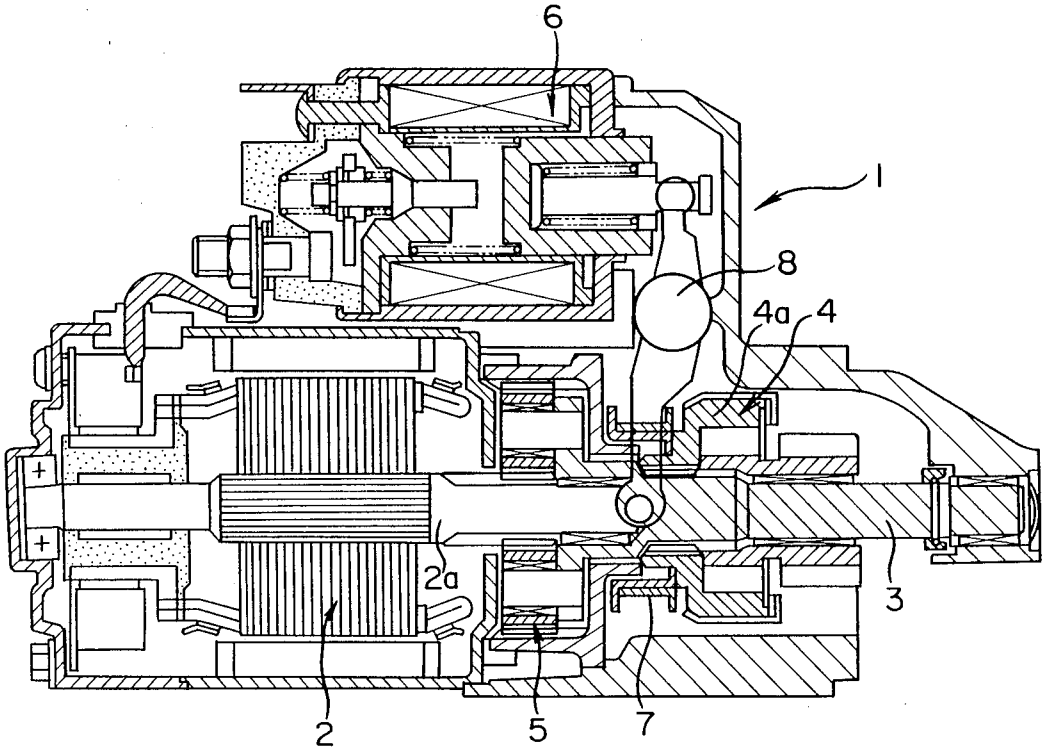
FIG. 1 is a longitudinal cross-sectional view of the conventional engine starter.

Thus, by effectively utilizing the electromagnetic force generated by the energization of the excitation coil 34, the plunger 35 is moved by a great force to the right in FIG. 1 along the axis. Therefore, the rod 39 pushes out the output rotary shaft 12 through the coil springs 46 and 43 and the pusher rod 44 so that the pinion 17 mounted on its end is brought into engagement with the ring gear of the engine.

At the same time, as the plunger moves, the movable contact 41*c* and the stationary contact 24 are brought into contact to energize the d.c. motor 11 to drive the d.c. motor 11. As a result, the rotation of the armature rotary shaft 11*a* is transmitted to the clutch outer member 15*a* of the over-running clutch mechanism 15 after it is speed-reduced by the planetary gear speed reduction unit 14, and the rotation of the clutch outer member 15*a* is transmitted to the clutch inner member 15*b* through the cylindrical rollers 15*c*. The rotation of the clutch inner member 15*b* is transmitted to the output rotary shaft 12 through the helical splines 15*c* and 12*b* and the pinion 17 is rotated, thereby starting the engine.

During this time, i.e., while the output rotary shaft 12 is being pushed out, the output rotary shaft 12 slides while being rotated in the direction of twist of the helical spline 12*a* because the output shaft 12 is in engagement with the clutch inner member 15*b* through the helical spline 12*a* and the helical spline 15*c*. At this time, a rotating force in the direction of rotation of the output rotary shaft 12 is applied to the return coil spring 50 because one end of the coil spring 50 is in abutment with the side face of the radially outwardly projecting portion 12*b* of the output rotary shaft 12. If the coil winding direction of the coil spring 50 is the same as the direction of rotation of the output rotary shaft 12, the coil diameter of the coil spring 50 is decreased by the twisting force to be wound on the output rotary shaft 12, generating a significant drag against the sliding movement of the output rotary shaft 12. Therefore, according to the present invention, the coil spring 50 is wound in a direction opposite to the direction of twist of the helical spline 12*a*. With this arrangement, the drag from the return coil spring 50 acting on the output rotary shaft 12 when it is sliding is substantially eliminated, eliminating the need for the magnetic attraction force of the solenoid switch assembly 30 to be large, enabling the solenoid switch assembly 30 to be small-sized.

Simultaneously with the output rotary shaft 12 being pushed out by the solenoid switch assembly 30, the movable contact 41*c* of the movable assembly 36 similarly moves axially toward the right in FIG. 2 as the rod 39 moves until it contacts the stationary contact 24 immediately before the pinion 17 on the tip of the output rotary shaft 12 meshes with the ring gear (not shown) of the engine. This causes the d.c. motor 11 to be energized by the electrical power source and the armature rotary shaft 11*a* is srotated. The rotation of the armature rotary shaft 11*a* is transmitted to the clutch outer member 15*a* of the over-running clutch mechanism 15 after it is speed-reduced by the planetary gear unit 14. The rotation of the clutch outer member 15*a* is transmitted to the clutch inner member 15*b* through the cylindrical rollers 15*d* of the over-running clutch mechanism 15. The rotation of the clutch inner member 15*b* is transmitted to the output rotary shaft 12 through the helical splines 15*c* and 12*b* and the pinion 17 is rotated, thereby starting the engine (not shown).

After the engine has been started, the output rotary shaft 12 is prevented from being reversely driven and the energization of the excitation coil 34 in the solenoid switch 30 is deenergized, so that the output rotary shaft 12 becomes free from the pushing out force, and the output rotary shaft 12 is returned to the original position by the return coil spring 50.

As has been described, according to the coaxial engine starter of the present invention, since the magnetic sleeve is removed from a moving space between the front and the rear magnetic path sections, the leakage of the magnetic flux in the solenoid switch assembly is significantly reduced, the electromagnetic force can effectively act on the plunger, and a greater magnetic attractive force can be obtained. Therefore, the starter can be made small-sized because the necessary magnetic attractive force can be maintained even when the solenoid switch assembly is made small-sized. The magnetic attractive force can be further increased by providing an outwardly facing tapered surface on the end of the rear core.

Also according to the coaxial engine starter of the present invention, the direction of wind of the return coil spring disposed around the output rotary shaft along its circumference is opposite to the direction of twist of the helical spline formed on the output rotary shaft, so that the drag acting on the output rotary shaft during its sliding movement can be made small, enabling the magnetic attaractive force of the solenoid switch asembly to be decreased and the solenoid switch assembly to be made small-sized.

I claim:

1. A coaxial engine starter comprising;

an electric motor for generating a rotating force for starting an engine;

an output rotary shaft disposed on one end of said motor in an axially aligned relationship with its armature rotary shaft and operatively connected to the armature rotary shaft through an over-running clutch mechanism; and a solenoid switch assembly disposed on the other end of said electric motor in an axially aligned relationship for supplying electric power to said motor and for axially sliding said output rotary shaft;

said solenoid switch assembly comprising a cylindrical excitation coil;

a plunger axially slidable within said excitation coil;

a front magnetic path section disposed on one end of said excitation coil in opposition to said plunger;

a rear magnetic path section disposed around the circumference of said plunger when it is in the return position;

a bushing made of an iron-system material and disposed between said rear magnetic path section and said plunger; and a non-magnetic sleeve disposed side by side relative to said iron-system bushing for guiding said plunger in a moving space from its return position to the position in which said plunger abuts against said front magnetic path section.

2. A coaxial engine starter as claimed in claim 1, wherein an end face of said rear magnetic path section on the side of said front magnetic path section is an outwardly facing slope surface.

3. A coaxial engine starter comprising;

an electric motor including a tubular armature rotary shaft, an over-running clutch mechanism;

an axially slidable output rotary shaft extending through a clutch inner member of said over-running clutch mechanism and in mesh with said clutch inner member and a helical spline, a rotating power being transmitted to said output rotary shaft through said over-running clutch mechanism;

a return coil spring disposed around said output rotary shaft and abutting at its one end with a side face of a radially outwardly projecting portion of said output rotary shaft; and a solenoid assembly capable of supplying electric power to said d.c. motor and simultaneously axially sliding said output rotary shaft;

said armature rotary shaft, said output rotary shaft and an output rotary shaft pushing rod of said solenoid switch assembly are aligned on a common axis;

the direction of twist of said helical spline formed on said output rotary shaft being opposite to the direction of wind of said return coil spring.

* * * * *